United States Patent [19]

Sardinskas

[11] Patent Number: 4,799,322

[45] Date of Patent: Jan. 24, 1989

[54] TANGLE RESISTANT LOCK PIN

[75] Inventor: Robert A. Sardinskas, Bethany, Conn.

[73] Assignee: Sarco Mfg. Co., Inc., Bethany, Conn.

[21] Appl. No.: 100,982

[22] Filed: Sep. 25, 1987

[51] Int. Cl.[4] ..... A44C 3/00

[52] U.S. Cl. ..... 40/1.5; 40/662; 40/642; 24/103

[58] Field of Search ..... 40/25, 1.5, 315, 24, 40/299

[56] References Cited

U.S. PATENT DOCUMENTS

| | | | |
|---|---|---|---|
| 265,986 | 10/1882 | Searing | 24/103 |
| 329,122 | 10/1885 | Bauer | 24/103 |
| 626,035 | 5/1899 | Phelps | 24/103 |
| 647,120 | 4/1900 | Silsby | 24/103 |
| 665,660 | 1/1900 | Jones | 40/1.5 |
| 696,570 | 4/1902 | Kimball | 24/103 |
| 842,782 | 1/1907 | Goerdes | 24/103 |
| 1,127,669 | 2/1915 | Nygaard | 24/103 |
| 1,254,382 | 1/1918 | Yoshizawa | 24/103 |
| 1,271,743 | 7/1918 | Morse | 40/24 |
| 1,301,435 | 4/1919 | Heller | 24/103 |
| 1,331,611 | 2/1920 | Bott | 24/103 |
| 1,441,275 | 1/1923 | Gittelsohn | 24/103 |
| 1,457,324 | 6/1923 | Taylor | 24/103 |
| 1,645,499 | 10/1927 | Fenton | 24/103 |
| 1,964,395 | 6/1934 | Weiss | 40/24 |
| 1,988,802 | 1/1935 | Mendelsohn | 40/24 |
| 1,992,337 | 2/1935 | Weiss | 40/24 |
| 2,573,876 | 11/1951 | Rodrigues | 24/103 |
| 3,224,059 | 12/1965 | Scheberle | 24/103 |
| 3,517,419 | 6/1970 | Friaglia | 24/103 |

FOREIGN PATENT DOCUMENTS 468930 7/1914 France .

*Primary Examiner*—Gene Mancene
*Assistant Examiner*—Wenceslao J. Contreras
*Attorney, Agent, or Firm*—DeLio & Associates

[57] ABSTRACT

A lock pin for a badge shell having a round periphery and inwardly bent skirt along the periphery forming an open back, the lock pin being made of a length of resilient wire having a substantially straight fastening portion with a lower pointed end on the wire first free end to fasten the badge to a garment. The resilient wire includes a shell securing portion connected to the upper end of the fastening portion extending in a closed generally planar path around the fastening portion and terminating in the wire second free end comprising a locking tab extending outwardly from the plane for removably locking the second free end to the fastening portion upper end, the locking tab further adapted to bear against the inward side of the shell securing portion to resist removal of the lock pin from the badge shell. The shell securing portion has first and second arcuate segments conforming substantially to the curvature of the shell inner periphery and extending approximately 90° on either side of the fastener portion upper end. The lower half of the shell securing portion has a "W" shape which includes a inwardly looping locking tongue portion to secure the fastening portion lower free end and wherein the sides form skirt clearing portions to facilitate assembly of the lock pin into the badge shell.

20 Claims, 1 Drawing Sheet

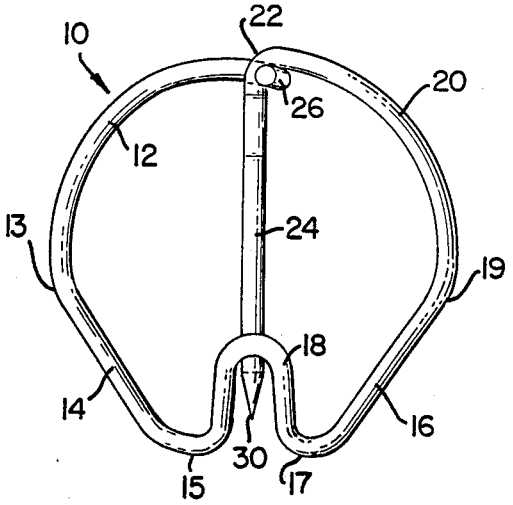
FIG. 1
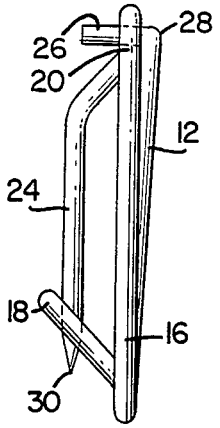
FIG. 2
FIG. 3
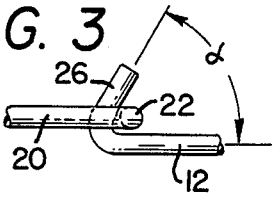
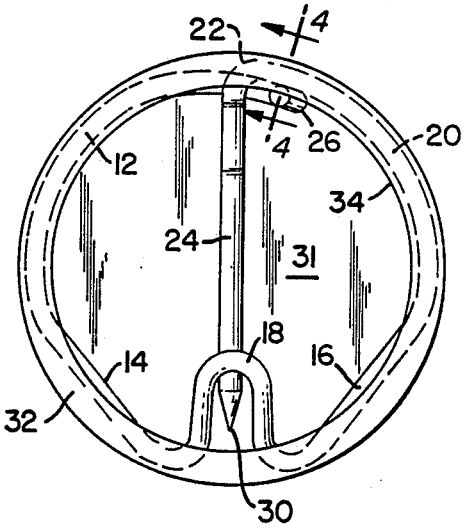
FIG. 4
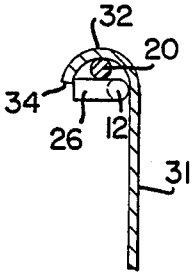
FIG. 5

TANGLE RESISTANT LOCK PIN

BACKGROUND OF THE INVENTION

The present invention relates to a lock pin for badges or the like and, in particular, a lock pin to secure said badge to a garment or the like which may be easily inserted into a badge shell having a round periphery and in inwardly bent skirt along the periphery and which includes a lock tab to resist removal from said badge shell.

Badges and badge pins have been long known in the art as evidenced by numerous references including U.S. Pat. Nos. 626,035; 665,660; 1,127,669; 1,331,611; and 1,441,275. These patents disclose various configurations of badge pins wherein the badge shell securing portion has a wire end which is free and exposed. This free end exposure has contributed to the tendency of these pins to tangle during bulk storage, handling and manufacture, and which also precludes automated assembly of these lock pins into badges.

Other badge pin references such as U.S. Pat. Nos. 265,986 and 842,782 disclose configurations wherein the securing portion free end is looped around the fastening portion. However, such pin configurations do not offer good stability in the badge shell. Additionally, none of the aforementioned patents disclose pin configurations which may be positively secured inside the badge shell, nor do they disclose configurations which offer the combination of easy insertion and stability in the badge shell.

French Pat. No. 468930 discloses a pin configuration which positively secures the wire end to the fastener portion, but this design is not suitable for use in a badge shell.

Bearing in mind these and other deficiencies and disadvantages of the prior art, it is therefore an object of the present invention to provide a badge locking pin which has a reduced tendency to tangle during bulk storage and handling and which facilitates manual or automated assembly with the badge.

It is another object of the present invention to provide a lock pin which is positively held and secured after assembly into a badge.

It is a further object of the present invention to provide a lock pin which may be easily and quickly inserted into a badge or button.

It is yet another object of the present invention to provide a lock pin for a badge which has all of the above advantages and which also is highly stable while secured in a badge.

SUMMARY OF THE INVENTION

The above and other objects which will be apparent to those skilled in the art are achieved in the present invention which relates to a lock pin for a badge shell having a round periphery and an inwardly bent skirt along the periphery forming an open back, the lock pin comprising a length of resilient wire having a substantially straight fastening portion with a lower pointed end on the wire first free end adapted to extend at least partially across the open back of the badge shell to fasten the badge to a garment. The resilient wire includes a shell securing portion, connected to the upper end of the fastening portion, extending in a closed generally planar path conforming at least partially to the curvature of the inner periphery of the badge shell completely around the fastening portion and terminating in the wire second free end comprising a locking tab extending outwardly of the plane of the shell securing portion for removably locking the second free end to the fastening portion upper end, the locking tab further adapted to bear against the inward side of the shell securing portion when the lock pin is inserted into the badge shell to resist removal of the lock pin from the badge shell. The shell securing portion has first and second arcuate segments conforming substantially to the curvature of the shell inner periphery on either side, respectively, of the fastener portion of upper end, each of the arcuate segments extending away from the fastener portion upper end to positions remote from the fastener portion. The shell securing portion may include a locking tongue portion comprising a loop extending inwardly from elbow portions corresponding to the shell inner periphery below the fastener portion free end for mating with and locking the fastening portion pointed free end. The shell securing portion may further comprise first and second skirt clearing segments, between the first and second arcuate segments, respectively, and the locking tongue elbow portions, each extending inward of the shell inner periphery to clear the edge of the inwardly bent skirt as the lock pin is compressed along its sides and inserted into the shell.

In another aspect, the present invention relates to a badge and lock pin assembly comprising a badge shell having a round periphery and an inwardly bent skirt along the periphery forming an open back, the badge shell having secured therein the aforedescribed lock pin wherein the shell securing arcuate and elbow segments are seated along the inner periphery of the badge shell and wherein the locking tab portion bears outwardly against the inward side of an arcuate segment to resist removal of the lock pin from the badge.

BRIEF DESCRIPTION OF THE DRAWINGS

FIG. 1 is a rear view of the preferred embodiment of the lock pin of the present invention.

FIG. 2 is a side view of the lock pin of FIG. 1.

FIG. 3 is a top view of a portion of the lock pin of FIG. 1 showing the locking tab.

FIG. 4 is the rear view of a badge shell having the lock pin of FIG. 1 inserted therein.

FIG. 5 is a cross-sectional view along the line 4-4 of FIG. 4.

DETAILED DESCRIPTION OF THE INVENTION

The lock pin of the present invention is preferably made of corrosion-resistant resilient steel wire, although other suitable materials well known in the art may be substituted. Reference will made herein to relative directions although it is to be understood that such reference is non-limiting and strictly for purpose of convenience and clarity of description throughout the drawings wherein like numerals refer to like features of the invention.

In FIGS. 1, 2 and 3 there is shown the preferred embodiment of lock pin 10 of the present invention, which lock pin is intended for assembly with a conventional badge shell having a round periphery and an inwardly bent skirt along its periphery forming an open back. For fastening the badge shell to a cloth garment or the like there is shown a lock pin fastening portion having a substantially straight lower portion 24 which terminates at a sharp pointed end 18 at a first free end of the wire forming the lock pin. This fastening portion extends substantially completely across the height or diameter of the lock pin as shown in FIGS. 1 and 2, and is intended to extend at least partially across the open back of the badge shell.

Connected to the upper end of the fastening portion is the shell securing portion of the lock pin. This shell securing portion is essentially planar and, at its first end, extends from an elbow 22 in a closed curved path which extends down around one (right) side of the fastener portion below the fastener pointed end 30 and up around the other (left) side of the fastener portion back towards elbow 22. The lock pin wire forms upper right arc segment 20 and upper left arc segment 12 which extend away from the upper end of the fastening portion and which conform substantially to the shape of the round inner periphery of the badge shell in which it is to be seated. As here shown, arc segments 12 and 20 substantially conform to 90° arcs of a circle and extend from the upper end of the fastener portion to remote lower ends 13, 19, respectively, at the sides of the lock pin. The lower bent elbow segments of the lock pin 15 and 17 also lie along the path of the inner periphery of the badge shell. As shown herein, the lock pin securing segments 12, 15, 17 and 20 are substantially planar, with fastener portion 24 being rearwardly spaced apart and essentially parallel to this plane.

To facilitate insertion of the lock pin into a badge shell, the lower portion of the lock pin shell securing portion forms a "W" shape formed by skirt-clearing segments 14 and 16 and locking tongue loop 18. Segments 14 and 16 are substantially straight and extend from the lower ends 13, 19, respectively, of arcuate segments 12, 20, respectively, to the lower bent elbow segments 15 and 17, respectively. The middle portion of the "W" shape consists of an inward looping locking tongue 18, between elbows 15 and 17, which extends outward from the plane of the shell securing portion at an angle and receives the pointed free end 30 of the fastener portion to secure the badge and lock pin assembly to the garment. Fastener portion 24 is removed from locking tongue portion 18 in the conventional manner of pressing to move the lower tip 30 toward the plane of the shell securing portion and then to the side of the locking tongue loop 18 to disengage it.

To prevent tangling of the lock pin during bulk storage, handling and assembly, and to assist in securing the lock pin to the badge shell, the other (second) free end of the wire forming the lock pin terminates in a locking tab 26 which extends outward and rearward of the plane of the shell securing portion. As shown in FIG. 3, in a top view, tab 26 wraps partially around elbow 22 and forms an acute angle $\alpha$ (alpha), preferably about 45°, with respect to the plane of shell securing portion. The resilient wire used for the lock pin is formed so that the shell securing portion in an unstressed condition is of larger diameter than that shown in Fig. 1. Locking tab 26 is connected to arcuate segment 12, which passes forward of the upper end of the fastening portion, and serves to hold the second free end of the wire within elbow 22 by inward compression of the wire to prevent second free end from tangling with other lock pins as they are packaged and moved in bulk form. This tangle-resistant configuration also serves to assist in automation of the handling and assembly of the lock pins in the badge shells. In the unassembled form shown in FIGS. 1 and 2, the outer diameter and periphery of the lock pin, with locking tab 26 engaged, is larger than the inner diameter and periphery of the badge shell for which the lock pin is made. This ensures that the resiliency of the wire will serve to assist in holding the lock pin in place in the badge.

In FIG. 4 there is shown the lock pin of FIGS. 1, 2 and 3 assembled within badge shell 31. As shown in Figs. 4 and 5, badge shell 31 has about its round periphery, shown here as being circular, an inwardly bent skirt or rim 32 which forms an open back to the badge shell. Skirt 32 has a free edge 34 which has a diameter less than the outer diameter of the badge shell.

To assembly the lock pin 10 into badge 31 inward pressure is applied approximately at points 13 and 19 to compress the diameter and periphery of the lock pin until it can be received within the opening formed by skirt edge 34. Because skirt clearing segments 14 and 16 extend inwardly of the arcuate shape of the shell periphery, they easily clear skirt edge 34 to allow lower elbows 15, 17 and upper arcuate segments 12, 20 to be separately inserted and seated within and against the inner periphery of shell skirt 32.

To utilize locking tab 26 in the manner intended by the present invention, the upper portion of arc segment 12 should be between fastening portion 24 and the front portion of badge 31, and locking tab 26 should be inward of arc segment 20. As shown in FIGS. 4 and 5, the compression of the resilient locking pin wire will cause an outward force which forces locking tab 26 outward to bear or rest against the inner side of arcuate segment 20 and seat segment 20 firmly against the inner periphery of badge shell skirt 32. As shown in FIG. 4, the compression of lock pin 10 during seating in badge 31 results in locking tab 26 being disengaged from the inside of the elbow at portion 22 and is spaced apart from fastener portion 24 while still being seated firmly against arc portion 20. The positioning of the upper portion of arcuate segment 12 forward of the upper end of the lock pin fastening portion serves to prevent locking tab 26 from moving rearwardly out of the open back side of badge shell 31 and out of engagement with arc segment 20.

The outward resilient force of the wire forming lock pin 10 causes shell securing portions 13, 15, 17, 19, 20 and a portion of arc segment 12 to be seated firmly about the inner periphery of badge skirt 32. The arcuate shape of segments 12 and 20, which conform to the inner periphery of skirt 32, along with the lower segments 15 and 17 ensure pin stability after assembly with badge 31. As shown in FIG. 4, skirt clearing segments 14 and 16 remain inward of the skirt 32 inner periphery and inwardly of skirt edge 34.

Thus, the present invention provides a tangle resistant configuration for badge lock pins which allows ease of manual assembly and the possibility of automation to hopper feed automatic assembly apparatus. The locking tab provides tangle resistance by securing and restraining the second free end of the pin so that it is not free to become entwined or tangled with other lock pins during bulk storage, handling or assembly. The locking tab is easily engaged and disengaged during assembly and thereafter serves to positively secure the lock pin to the badge. The lower skirt clearing segments 14 and 16, which together with the locking tongue form a "W" shape, allow for easy insertion of the pin to clear the badge skirt edge.

While this invention has been described with reference to a specific embodiment, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. A lock pin for a badge shell having a round periphery and an inwardly bent skirt along said periphery forming an open back, said lock pin comprising:

a length of resilient wire having a fastening portion with a lower pointed end on the wire first free end adapted to extend at least partially across the open back of said badge shell to fasten said badge to a garment;

said wire having a shell securing portion, connected at a first end to the upper end of said fastening portion, extending in a closed generally planar path conforming at least partially to the curvature of the inner periphery of said badge shell completely around said fastening portion and terminating in the wire second free end comprising a locking tab extending outwardly from the plane of said shell securing portion for removably locking said second free end to said fastening portion upper end, said locking tab further adapted to bear against the inward side of the shell securing portion when the lock pin is inserted into said badge shell to resist removal of said lock pin from said badge shell.

2. The lock pin of claim 1 wherein said shell securing portion has first and second arcuate segments conforming substantially to the curvature of said shell inner periphery on either side, respectively, of said fastener portion of upper end, each of said arcuate segments extending away from said fastener portion upper end to positions remote from said fastener portion;

said shell securing portion having a locking tongue portion comprising a loop extending inwardly from elbow portions corresponding to said shell inner periphery below said fastener portion free end for mating with and locking said fastening portion pointed free end;

said shell securing portion further having first and second skirt clearing segments, between said first and second arcuate segments, respectively, and said locking tongue elbow portions, each extending inward of said shell inner periphery to clear the edge of said inwardly bent skirt as said lock pin is compressed along its sides and inserted into said shell.

3. The lock pin of claim 1 wherein said locking tab forms an acute angle with respect to the plane of said shell securing portion.

4. The lock pin of claim 2 wherein said locking tab is adapted to bear against one of said arcuate portions to resist removal of said lock pin from said badge.

5. The lock pin of claim 2 wherein said skirt clearing portions are substantially straight.

6. The lock pin of claim 2 wherein said badge shell has a circular periphery and wherein said arcuate segments of said shell securing portion are arcs of a circle.

7. The lock pin of claim 2 wherein each of said first and second arcuate segments comprise about 90° of the curved path of the shell securing portion.

8. The lock pin of claim 2 wherein said skirt clearing portions and said locking tongue portion form the shape of a "W".

9. The lock pin of claim 3 wherein the angle of said locking tab is about 45°.

10. A badge and lock pin assembly comprising a badge shell having a round periphery and an inwardly bent skirt along said periphery forming an open back, said badge shell having secured therein the lock pin of claim 2 wherein said shell securing arcuate and elbow segments are seated along the inner periphery of said badge shell and wherein said locking tab portion bears outwardly against the inward side of an arcuate segment to resist removal of said lock pin from said badge.

11. A lock pin for a badge shell having a round periphery and an inwardly bent skirt along said periphery forming an open back, said lock pin comprising:

a length of resilient wire having a fastening portion with a lower pointed end on the wire first free end adapted to extend at least partially across the open back of said badge shell to fasten said badge to a garment;

said wire having a shell securing portion, connected by an elbow at a first end to the upper end of said fastening portion, extending in a closed generally planar path conforming at least partially to the curvature of the inner periphery of said badge shell completely around said fastening portion and terminating in the wire second free end comprising a locking tab extending outwardly from the plane of said shell securing portion at an acute angle for removably locking said second free end to said fastening portion upper end, said locking tab further adapted to bear against the inward side of the shell securing portion near said elbow when the lock pin is inserted into said badge shell with the wire second end extending between the fastening portion and the badge shell and the locking tab inward of the shell securing portion to resist removal of said lock pin from said badge shell.

12. The lock pin in claim 11 wherein said shell securing portion has first and second arcuate segments conforming substantially to the curvature of said shell inner periphery on either side, respectively, of said fastener portion of upper end, each of said arcuate segments extending away from said fastener portion upper end to positions remote from said fastener portion;

said shell securing portion having a locking tongue portion comprising a loop extending inwardly from elbow portions corresponding to said shell inner periphery below said fastener portion free end for mating with and locking said fastening portion pointed free end;

said shell securing portion further having first and second skirt clearing segments, between said first and second arcuate segments, respectively, and said locking tongue elbow portions, each skirt clearing segment being substantially straight and extending inward of said shell inner periphery to clear the edge of said inwardly bent skirt as said lock pin is compressed along its sides and inserted into said shell, said skirt clearing portions and said locking tongue portion forming the shape of a "W".

13. The lock pin of claim 12 wherein said badge shell has a circular periphery and wherein said arcuate segments of said shell securing portion are arcs of a circle comprising about 90° of the curved path of the shell securing portion, and wherein said locking tab is adapted to bear against one of said arcuate portions to resist removal of said lock pin from said badge.

14. The lock pin of claim 13 wherein the angle of said locking tab is about 45°.

15. A badge and lock pin assembly comprising a badge shell having a round periphery and an inwardly bent skirt along said periphery performing an open back, said badge shall having secured therein a lock pin comprising a length of resilient wire having a fastening portion with a lower pointed end on the wire first free end adapted to extend at least partially across the open back of said badge to fasten said badge to a garment;

said wire having a shell securing portion, connected by an elbow at a first end to the upper end of said fastening portion, extending in a closed generally planar path conforming at least partially to the curvature of and seated along the inner periphery of said badge shell completely around said fastening portion and terminating in the wire second free end comprising a locking tab extending outwardly from the plane of said shell securing portion at an acute angle, said locking tab portion bearing outwardly toward the inward side of the shell securing portion near said elbow to resist removal of said lock pin from said badge.

16. The lock pin of claim 15, wherein said shell securing portion has first and second arcuate segments conforming substantially to the curvature of and seated along said shell inner periphery on either side, respectively, of said fastener portion of upper end, each of said arcuate segments extending away from said fastener portion upper end to positions remote from said fastener portion;

said shell securing portion having a locking tongue portion comprising a loop extending inwardly from elbow portions seated along said shell inner periphery below said fastener portion free end for mating with and locking said fastening portion pointed free end;

said shell securing portion further having first and second skirt clearing segments, between said first and second arcuate segments, respectively, and said locking tongue elbow portions, each skirt clearing segment being substantially straight and extending inward of said shell inner periphery to clear the edge of said inwardly bent skirt as said lock pin is compressed along it sides and inserted into said shell.

17. The lock pin of claim 15 wherein said badge shell has a circular periphery and wherein said arcuate segments of said shell securing portion are arcs of a circle.

18. The lock pin of claim 17 wherein each of said first and second arcuate segments comprise about 90° of the curved path of the shell securing portion.

19. The lock pin of claim 16 wherein said skirt clearing portions and said locking tongue portion from the shape of a "W".

20. The lock pin of claim 19 wherein the angle of said locking tab is about 45°.

* * * * *

UNITED STATES PATENT AND TRADEMARK OFFICE

CERTIFICATE OF CORRECTION

PATENT NO. : 4,799,322

DATED : January 24, 1989

INVENTOR(S) : Robert A. Sardinskas

It is certified that error appears in the above-identified patent and that said Letters Patent is hereby corrected as shown below:

In the specification:

Column 4, Line 12, delete "assembly" and substitute therefor --assemble--.

In the Claims

Column 7, Line 7, delete "shall" and substitute therefor --shell--.

Signed and Sealed this

Twenty-fifth Day of July, 1989

*Attest:*

*Attesting Officer*

DONALD J. QUIGG

*Commissioner of Patents and Trademarks*